US010753698B2

(12) United States Patent
McInerney, III et al.

(10) Patent No.: US 10,753,698 B2
(45) Date of Patent: Aug. 25, 2020

(54) TRIGGER SYSTEM WITH SAFETY

(71) Applicants: Edward A. McInerney, III, Lake Havasu City, AZ (US); Harold S. Boerschinger, Lake Havasu City, AZ (US)

(72) Inventors: Edward A. McInerney, III, Lake Havasu City, AZ (US); Harold S. Boerschinger, Lake Havasu City, AZ (US)

(73) Assignee: E3 Arms, LLC, Lake Havasu City, AZ (US)

( * ) Notice: Subject to any disclaimer, the term of this patent is extended or adjusted under 35 U.S.C. 154(b) by 0 days.

(21) Appl. No.: 15/970,036

(22) Filed: May 3, 2018

(65) Prior Publication Data

US 2018/0328687 A1 Nov. 15, 2018

Related U.S. Application Data

(60) Provisional application No. 62/505,764, filed on May 12, 2017.

(51) Int. Cl.

| | |
|---|---|
| ***F41A 17/00*** | (2006.01) |
| ***F41A 17/46*** | (2006.01) |
| ***F41A 19/10*** | (2006.01) |

(52) U.S. Cl.

CPC ..... *F41A 17/46* (2013.01); *F41A 19/10* (2013.01)

(58) Field of Classification Search

CPC ..... F41A 19/10; F41A 19/12

See application file for complete search history.

(56) References Cited

U.S. PATENT DOCUMENTS

| | | | | |
|---|---|---|---|---|
| 3,029,708 A * | 4/1962 | Marchisio | F41A 19/03 | 42/69.03 |
| 5,913,261 A * | 6/1999 | Guhring | F41A 3/64 | 42/69.03 |
| 6,125,735 A * | 10/2000 | Guhring | F41A 19/02 | 42/69.03 |
| 6,640,479 B2 * | 11/2003 | Guhring | F41A 19/16 | 42/69.03 |
| 2017/0276447 A1 * | 9/2017 | Foster | F41A 19/10 | |

FOREIGN PATENT DOCUMENTS

| | | | |
|---|---|---|---|
| DE | 102006048436 A1 * | 2/2008 | F41A 19/16 |

* cited by examiner

*Primary Examiner* — Gabriel J. Klein

(74) *Attorney, Agent, or Firm* — Buchalter, a professional corp.; Kari Barnes

(57) ABSTRACT

Exemplary embodiments include a completely redesigned fire control group to allow the safety to be engaged at any time. This unique feature can reduce or eliminate the possibility of accidental discharges of the weapon system, as engaging the safety will not allow the hammer to move forward even in the event of a malfunction.

11 Claims, 7 Drawing Sheets

TRIGGER SYSTEM WITH SAFETY

PRIORITY

This application claims priority to U.S. Application No. 62/505,764, filed May 12, 2017, which is incorporated by reference in its entirety into this application.

BACKGROUND

With the existing M4/AR-15 or variant rifles, the safety can only be engaged due to mechanical design, if the rifle is in the "cocked" or battery position. This allows for more opportunity for accidental discharge of the weapon since the hammer is cocked before the safety is engaged.

SUMMARY

Exemplary embodiments include a completely redesigned fire control group to allow the safety to be engaged at any time. This unique feature can reduce or eliminate the possibility of accidental discharges of the weapon system, as engaging the safety will not allow the hammer to move forward even in the event of a malfunction.

Exemplary embodiments include a control group for a weapon, comprising a trigger having a first portion configured to be engaged by a user to fire the weapon, a second portion configured to contact a hammer and retain the hammer in a ready to fire position and to move relative to the hammer when the first portion is engaged by a user to release the hammer and fire the weapon, and a third portion configured to contact a selector and prevent the firing of the weapon when the weapon is in a safe mode. The control group may be configured such that the second portion and third portion move relative to each other.

Exemplary embodiments include a method of transitioning a rifle into a safe mode, comprising providing a rifle comprising a hammer, a selector, and a trigger having a first portion configured to be engaged by a user to fire the weapon, a second portion configured to contact the hammer and retain the hammer in a ready to fire position and to move relative to the hammer when the first portion is engaged by a user to release the hammer and fire the weapon, and a third portion configured to contact a selector and prevent the firing of the weapon when the weapon is in a safe mode; positioning the selector into the safe mode position before the hammer is positioned in the ready to fire position; transitioning the hammer into contact with the second portion to retain the hammer in a ready to fire position after the selector is positioned into the safe mode position. The positioning of the selector may include moving the second portion relative to the first portion during the transition of the selector.

DRAWINGS

Figure 3A:
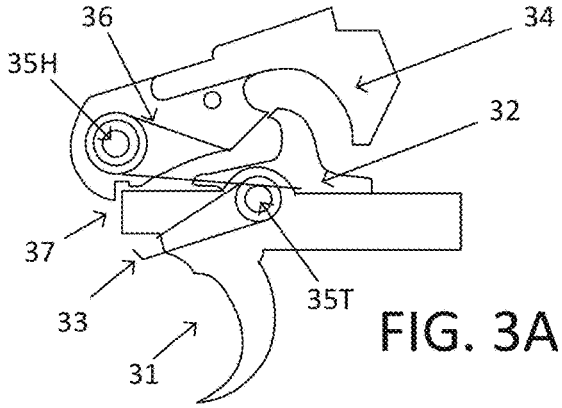
Figure 3B:
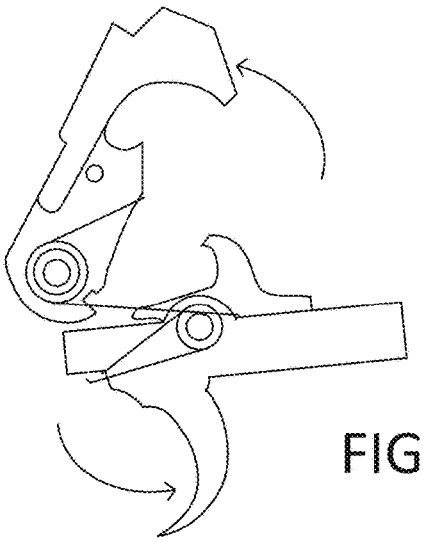

FIGS. 3A-3B illustrates an exemplary partially assembled trigger system. FIG. 3A illustrates the trigger system in a "cocked" or ready to fire position. FIG. 3B illustrates the trigger system in the fired position with arrows indicating the movement of the parts from the cocked position to the fired position.

Figure 4A:
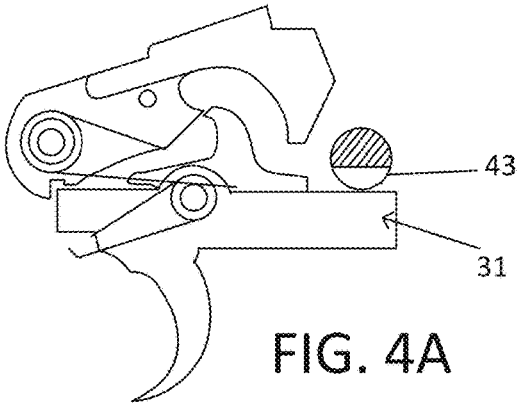
Figure 4B:
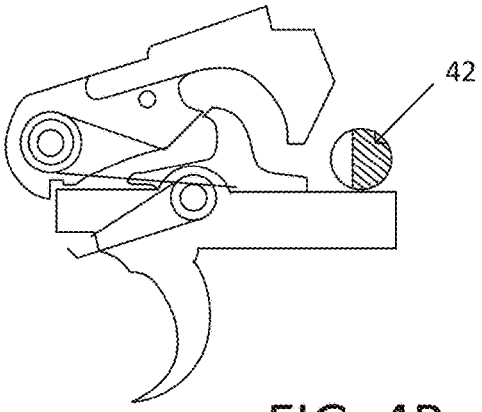

FIGS. 4A-4B illustrate an exemplary trigger system of FIG. 3A having a safety selector.

FIGS. 5A-5D illustrate an exemplary embodiment of a trigger system according to embodiments described herein.

Figure 6:
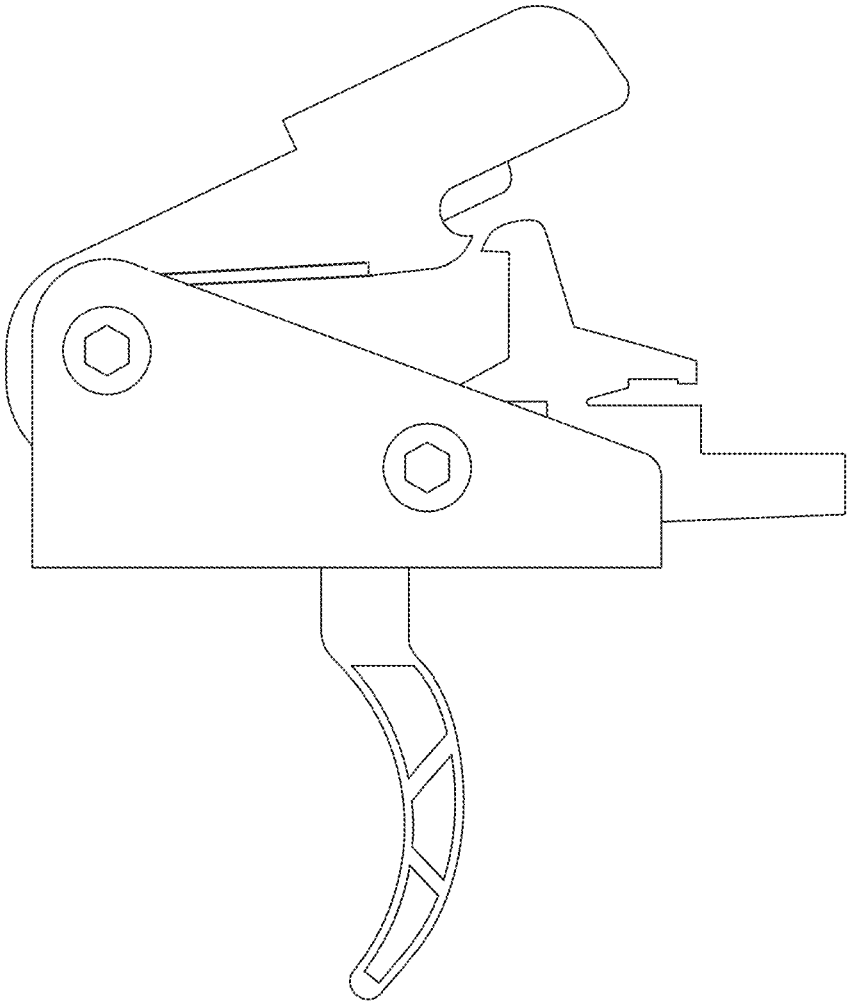

FIG. 6 illustrates an exemplary configuration including a trigger guard.

Figure 7A:
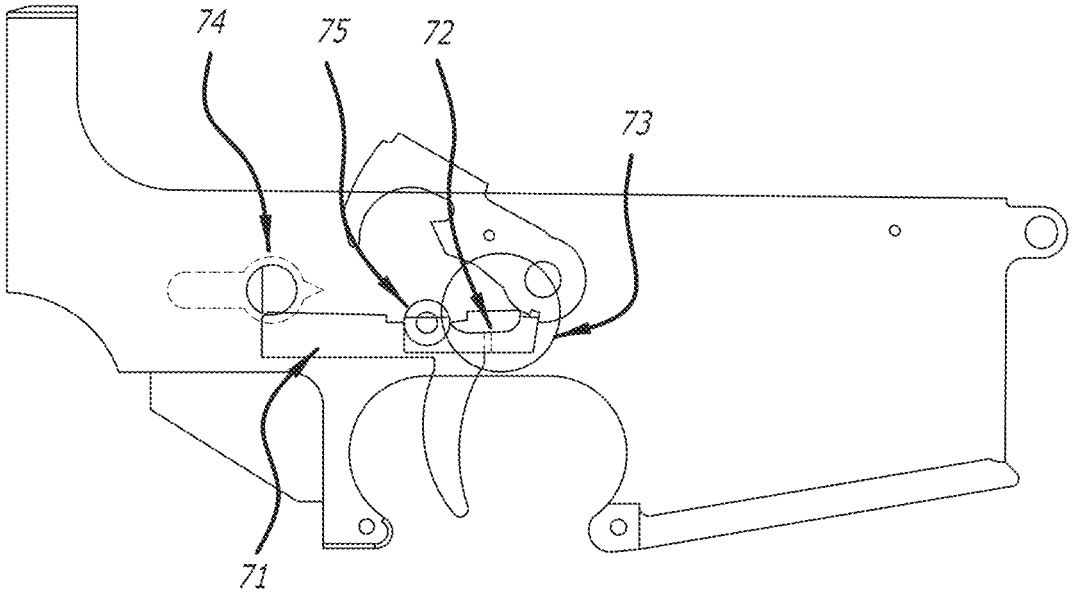
Figure 7B:
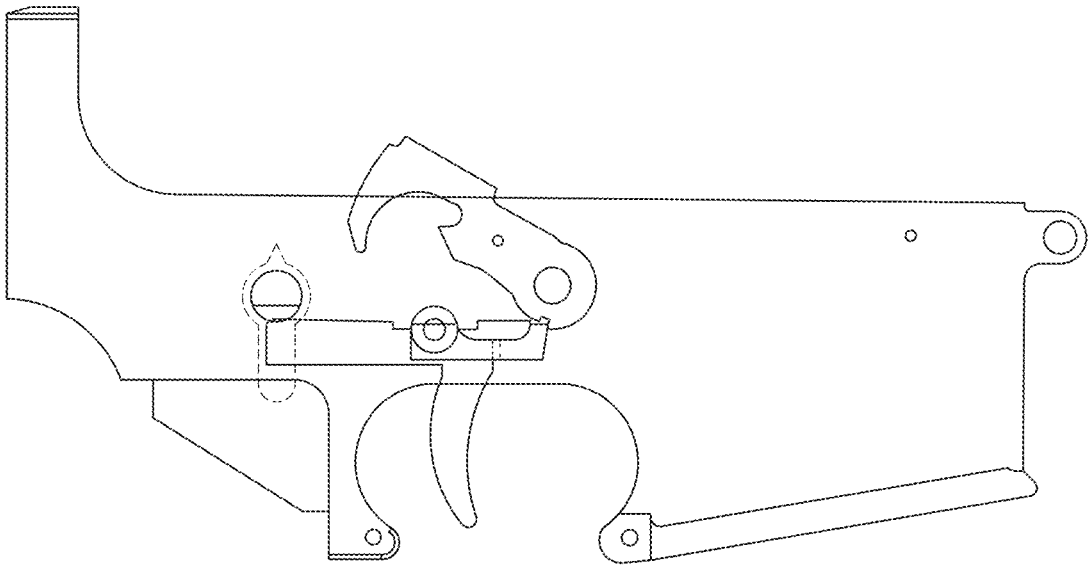

FIGS. 7A-7B illustrate an exemplary embodiment of a trigger system according to embodiments described herein.

Figure 8A:
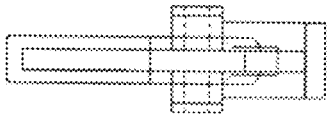
Figure 9A:
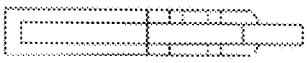
Figure 8B:
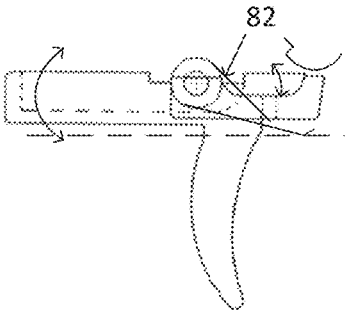

FIGS. 8A-8B illustrate different vies of an exemplary trigger system according to embodiments described herein.

FIGS. 9A-10B illustrate different views of exemplary component parts of the trigger system of FIGS. 8A-8B.

Figure 11:
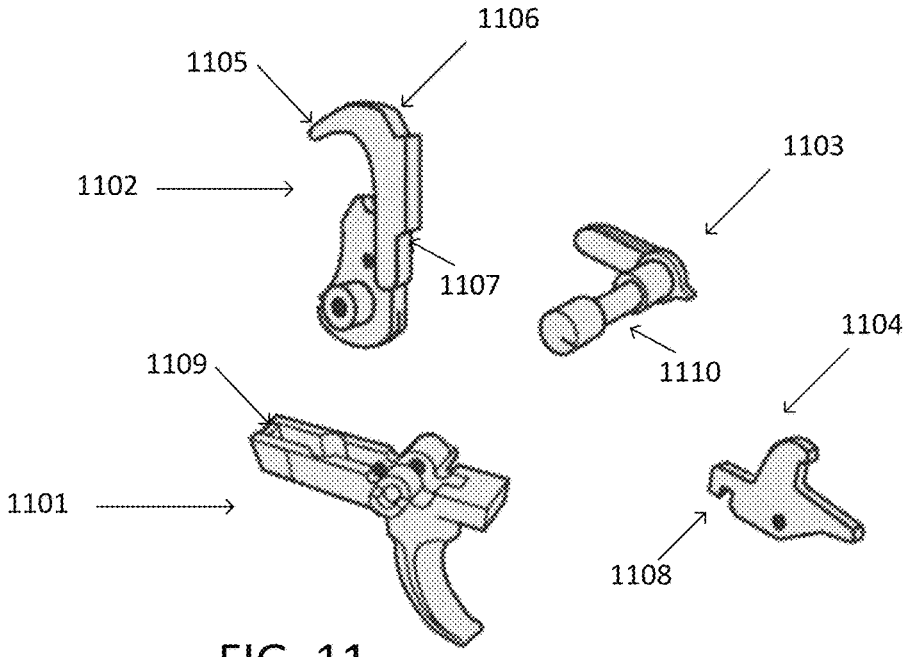
Figure 12:
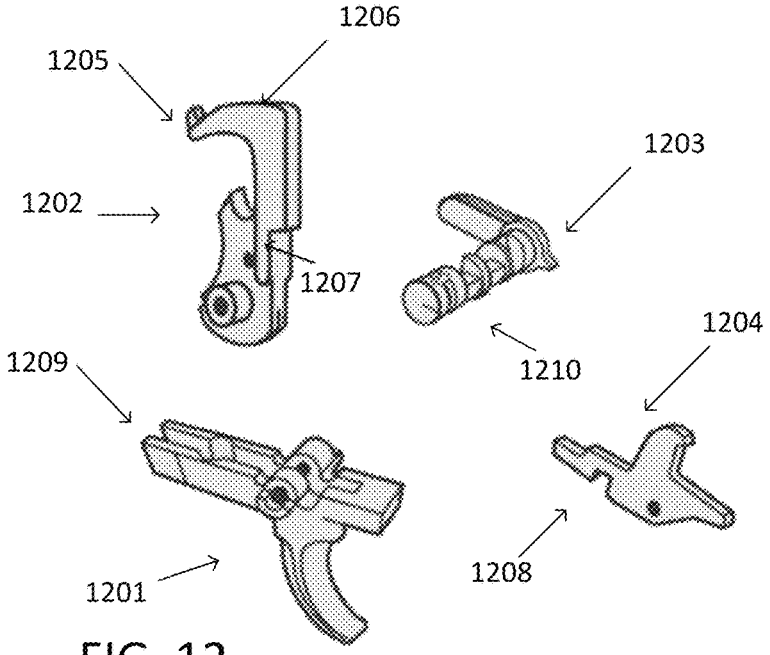

FIGS. 11-12 illustrate exemplary exploded component part views of control systems according to embodiments described herein.

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments include a completely redesigned fire control group to allow the safety to be engaged at any time. The fire control group may include a trigger in which a first part of the trigger may move relative to another part of the trigger such that the safety may transition from a ready to fire position to a safe position regardless of the position of the hammer.

Figure 1:
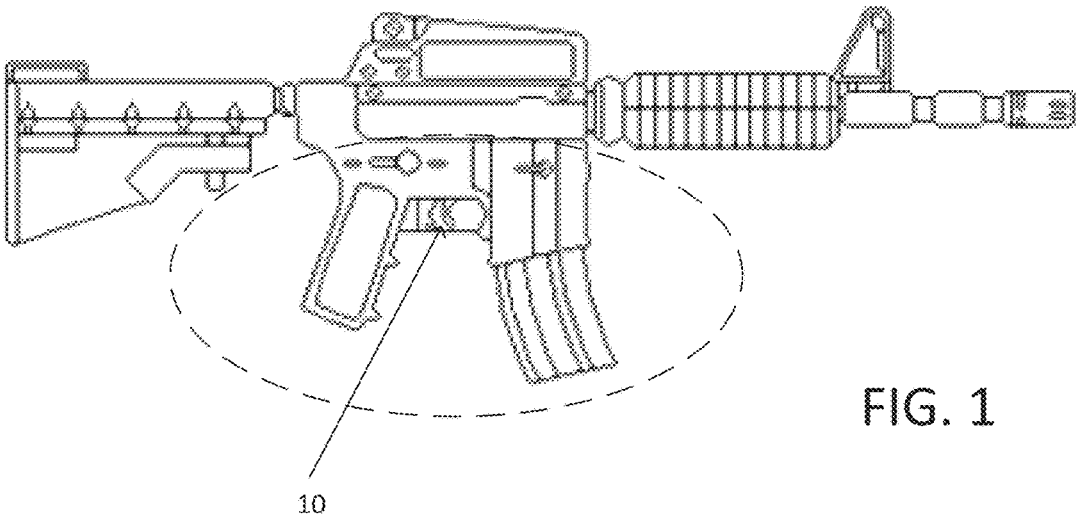
FIG. 1 illustrates an exemplary AR 15 style rifle.
Figure 2:
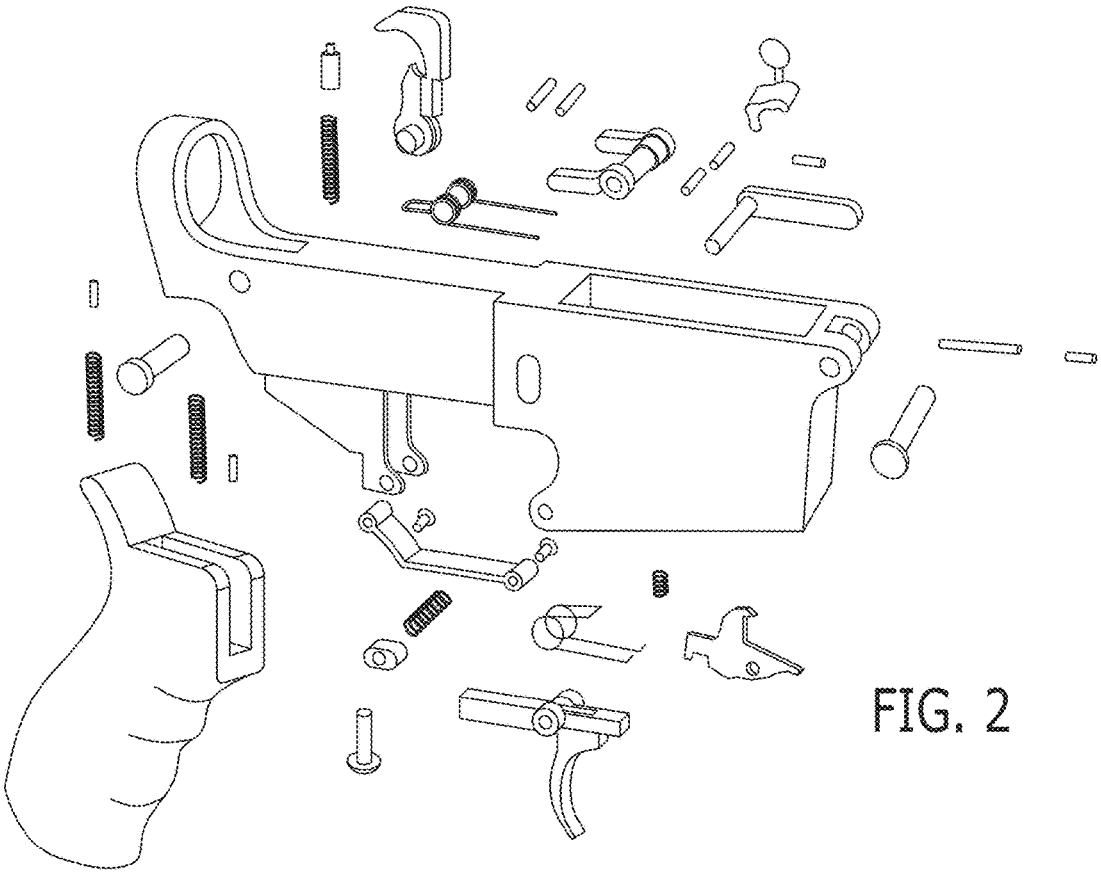
FIG. 2 illustrates an exemplary exploded view of a conventional lower receiver.

FIG. 1 illustrates an exemplary AR 15 style rifle. The lower receiver of the AR 15 is indicated within the dotted circle of FIG. 1. The lower receiver includes the trigger guard, the detachable pistol grip, the magazine well, and trigger system 10. FIG. 2 illustrates an exemplary exploded view of a conventional lower receiver. The trigger system includes a trigger 31, disconnector 32, trigger spring 33, hammer 34, pins 35H/35T, hammer spring 36, and trigger guard, and various other springs, pins, and connectors.

FIGS. 3A-3B illustrates an exemplary partially assembled trigger system. FIG. 3A illustrates the trigger system in a "cocked" or ready to fire position. FIG. 3B illustrates the trigger system in the fired position with arrows indicating the movement of the parts from the cocked position to the fired position. When in a cocked position, the hammer 34 and trigger 31 have mating surfaces 37 that are engaged. The trigger is positioned within an indentation of the hammer that prevents the hammer from rotating until the trigger is depressed. When the trigger is depressed, the trigger rotates about the pin 35T removing the engagement of the trigger from the hammer. The hammer spring 36 then applies the force to rotate the hammer 34 about its pin 35H and fire the weapon.

FIGS. 4A-4B illustrate the same trigger system of FIG. 3A having a safety pin. The selector is used to position the weapon in a safe mode or ready to fire mode and is conventionally referred to as the weapon's safety. The selector includes a shaft 42 that contacts the trigger 31 when positioned in the safe mode as seen in FIG. 4B. The shaft 42 of the selector includes an indentation 43 that takes the selector out of contact with the trigger in the ready to fire mode. The selector transitions from the ready to fire mode and safe mode by rotating about an axis of the shaft.

Because of the position of the trigger when the weapon is not yet cocked or ready to fire, the safety cannot be engaged until the weapon is cocked or ready to fire. For example, as seen by the comparison of FIGS. 3B to 4B, it can be imagined that the trigger would be positioned within the indentation of the shaft of the selector and would not permit the selector to fully rotate to the engaged or safe position. Instead, an inside surface of the indentation would contact the trigger and prevent full rotation. Accordingly, the system cannot be made safe until after the weapon is ready to fire. There is a period between cocking the weapon and engaging the safety that accidental misfires may occur.

Current fire control groups allow for an unsafe condition during and after charging the weapon. Exemplary embodiments described herein may eliminate or reduce those unsafe conditions by allowing the safety to be engaged at any or all times. There are no other known devices that allow the safety to be engaged in both the charged or uncharged hammer position. Current fire controls allow the weapon to be in an unsafe condition during the handling of the weapon, with no mechanical aspects to prevent an accidental discharge during and after charging or discharging the weapon.

By modifying the trigger bar of the traditional system, exemplary embodiments allow the safety selector switch to move independently of the hammer. Exemplary embodiments may be used to prevent the binding of the hammer, trigger, and selector assemblies that a solid trigger bar creates. Exemplary embodiments of the fire control described herein may not have to be placed on "safe" only after charging the weapon. The weapon can be on "safe" at any time (charged, uncharged or while clearing a malfunction), thus preventing accidental discharge when activated by the user.

An exemplary trigger system according to embodiments described herein allows the hammer to move independently of the trigger and selector switch. By shortening the trigger bar and replacing the removed portion with a spring-assisted pivot point, the safety selector is allowed the mechanical feasibility to actuate at any given point or condition of the rifle, which was previously mechanically impossible due to the design of the components.

FIGS. 5A-5D illustrate an exemplary embodiment of a trigger system according to embodiments described herein. The conventional trigger bar 31 has been removed and replaced with a first portion trigger bar 51 and second portion trigger bar 52. The second portion of the trigger bar 52 may be supported by a spring 54 against the receiver floor 55 to retain the trigger system in a biased position.

Figure 5A:
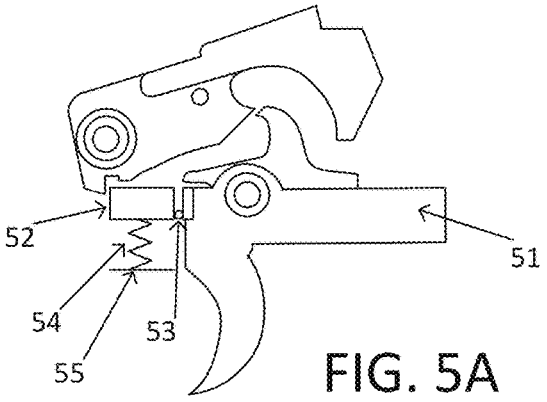
Figure 5C:
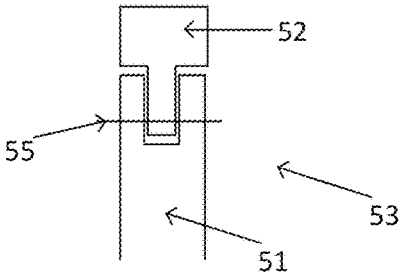
Figure 5B:
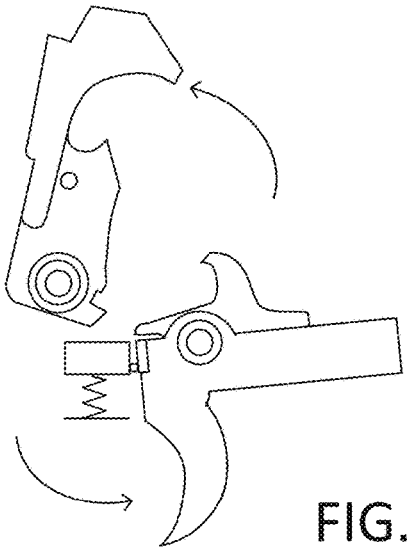
Figure 5D:
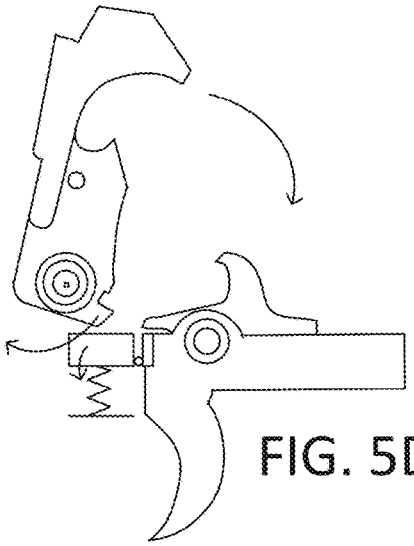

The first and second portion trigger bars are coupled through a pivot point 53. As shown in FIG. 5D, the pivot point 53 may permit the second portion trigger bar 52 to rotate independent of the motion of the first portion trigger bar 51. In this was, the second portion trigger bar 52 may be pushed down as the hammer is rotated from the fired position to the cocked position. The spring 55 may move the second portion trigger bar 52 into the notch of the hammer such that the weapon is in a ready to fire position, as shown in FIG. 5A. Because the second portion trigger bar 52 may move independent of the first portion trigger bar 51, the first portion trigger bar 51 may be positioned lower in the weapon body and not interfere with the motion of the selector. Accordingly, the safety may be engaged at any time, whether the weapon is armed or not. When the weapon is ready to fire, the user depresses the trigger, as illustrated in FIG. 5B. The trigger is an extension of the first portion trigger bar 51 which moves both the first portion trigger bar 51 and second portion trigger bar 52. The motion moves the second portion trigger bar 52 out of the way of the hammer to permit the hammer to rotate and fire the weapon.

In an exemplary embodiment, the pivot point 53, may permit rotation of the second portion trigger bar 52 with the respect to the first portion trigger bar 51 over a defined arc distance. As seen in FIG. 5D, the second portion trigger bar 52 may move in a first direction against the spring as indicated by the arrow. However, as seen in FIG. 5B, during engagement of the trigger, the trigger bar may act as a unitary piece and not rotate or only have limited rotation between the portions. Accordingly, the first and second portion trigger bar may be configured to define a bar of a first configuration, and a second configuration. The trigger bar may be configured to transition between the first and second configurations. The transition may define a limit such that the first portion and second portion do not translate or rotate with respect to each other outside of a range between the first position and the second position.

In an exemplary embodiment, the pivot point 53 may be created by a hinge. As illustrated in FIG. 5C, the hinge may be a tongue and groove hinge having a roll pin therethrough. The roll pin may be positioned adjacent a lower edge of the trigger bar to permit the rotation of the second portion trigger bar downward below the hinge and away from the hammer. The tongue and grove may be configured such that the first portion trigger bar and second portion trigger bar contact and act as a stop for further relative motion in one direction. As illustrated, the contact may be at the top portion of facing sides of the first and second portion trigger bars. The first and second portions may contact or bind to prevent further motion in a first direction but may rotate freely for an arc length in a second direction. The trigger system may also have a second stop to prevent further motion of the first and second portions in the second direction.

Exemplary embodiments may use a spring to bias the second portion of trigger bar. In an exemplary embodiment, the spring may be between the trigger bar and the receiver floor, may be between the trigger bar and the receiver housing, or combinations thereof. The spring may be press fit within the second portion trigger bar, counter sunk and pressed into the second portion trigger bar, may be positioned on an underside of the second portion trigger bar, or otherwise configured. In an exemplary embodiment, the spring is an HK style spring.

As shown with respect to FIG. 5B, when the trigger is depressed, the first and second portions of the trigger bar rotate about the pivot point to move the second portion of the trigger bar out of contact with the hammer, thereby permitting the hammer to rotate and fire the weapon.

FIG. 6 illustrates an exemplary configuration including a trigger guard. The trigger guard may be slotted to accommodate the spring or other components of an exemplary trigger system according to embodiments described herein.

FIGS. 7A-7B illustrate an exemplary embodiment of a trigger system according to embodiments described herein. Similar to the embodiment of FIGS. 5A-5D, the trigger comprises a first portion trigger bar 71 and a second portion trigger bar 73. The first portion and second portion trigger bars permit relative motion between the portions. The second portion trigger bar may be positioned 73 relative to the hammer (i.e. to position the weapon in a firing position) without regard for the position of the first portion trigger bar. The safety may be positioned and changed position regardless of the position of the hammer.

FIG. 7A illustrates an exemplary trigger system with the selector in a safe configuration. As see, the safety has a surface in contact with the first portion trigger bar such that the trigger cannot rotate and disengage the hammer. FIG. 7A also illustrates the hammer in the cocked or ready to fire position, such that the hammer is engaged with the second portion trigger bar. FIG. 7B illustrates an exemplary trigger system with the selector in a ready to fire position such that the selector rod is out of contact with the first portion trigger bar and permits the trigger to rotate and disengage the hammer.

Figure 10A:
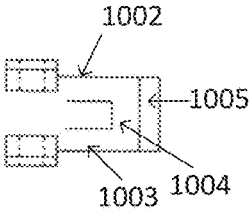
Figure 9B:
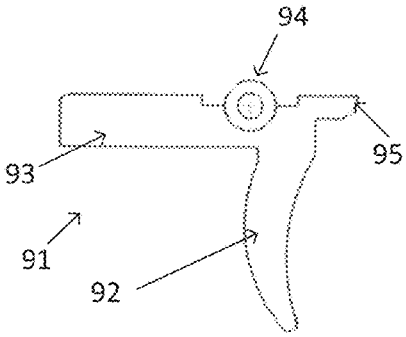
Figure 10B:
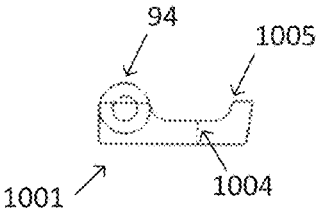

FIGS. 8A-10B illustrate exemplary component views of an exemplary trigger system according to embodiments described herein. FIGS. 8A-8B illustrate top and side views of an exemplary trigger comprising a first portion trigger bar and second portion trigger bar. FIGS. 9A-9B illustrate top and side views of an exemplary first portion trigger bar. FIGS. 10A-10B illustrate top and side views of an exemplary second portion trigger bar.

As seen in FIG. 9B, the first portion trigger bar 91 includes a trigger 92 and cross bar 93. The cross bar 93 is the portion configured to contact the shaft of the selector and prevent firing of the weapon when the trigger is pressed and the selector is in a safety position. The cross bar 93 also supports an aperture 94 for the trigger pin (not shown). The first portion trigger bar 91 also includes a forward projection 95 extending forward of the trigger 92 and the aperture 94. In an exemplary embodiment, the forward projection 95 may be generally aligned with the cross bar 93, or extend in a linear direction generally parallel to the cross bar 93. In an exemplary embodiment, the cross bar 93, forward projection 95, and trigger 92 form an integrated, monolithic construction. The first portion trigger bar 91 may be a rigid structure such that each part does not move relative to another part. The trigger, cross bar, and forward projection may be in a static relative position with respect to each other.

As seen in FIG. 10A, the second portion trigger bar 1001 may include a generally u-shaped body as seen from above. The second portion trigger bar 1001 may include a first part 1002 and second part 1003 generally co-extensive in length, running generally parallel to each other along the trigger bar. A connecting part 1004 may traverse between the first and second parts and couple the terminal ends of the first part to the second part. The first part 1002, second part 1003 and connecting part 1004 may form a generally planar section of the second portion trigger bar. Extending upward from the first part and second part may be a first and second ring to form the aperture 94. Extending upward from the connecting portion may be a terminal lip 1005. The terminal lip may project upward and be angled out of plane with respect to the plane of the first part and second part. The terminal lip 1005 may be angled at approximately 90-135 degrees relative to the first and second parts.

As seen in FIGS. 8A-8B, the second portion trigger bar 1001 is configured to position around a portion of the first portion trigger bar 91. For example, a portion of the first portion trigger bar 91 may be positioned between a portion of the first part 1002 and second part 1003 of the second portion trigger bar 1001. The apertures 94 may align between the first portion trigger part and second portion trigger part such that a single trigger pin may be used to couple the parts together. The projection 95 of the first portion trigger part 91 may be positioned above and rest against the connecting part 1004 of the second portion trigger bar 1001. The terminal lip may be positioned adjacent the hammer and may contact the hammer. The lip may engage the hammer and hold the hammer in a ready to fire position. Upon removal of the lip, the hammer may transition between the ready to fire position and the fired position. The weapon may be fired by pressing the trigger 92 and rotating the first portion trigger bar 91 about the axis of the trigger pin 94. The rotation of the trigger 92 moves the forward projection 95. The forward projection 95 contacts the connecting part of the second portion trigger bar 1001 and moves the section portion trigger bar. The movement of the second portion trigger bar brings the terminal lip out of contact with the indentation on the hammer such that the hammer may rotate and fire the weapon. The trigger system may include a trigger spring 82 to bias the first portion trigger bar and second portion trigger bar The cross bar 93 and second portion trigger bar 1001 both support an aperture 94 for the trigger pin. The aperture 94 may include a rim on the first portion trigger bar, second portion trigger bar, or a combination thereof, that projects outward from the aperture along the axis of an inserted pin. The rim provides an exterior circumference to position the trigger spring 82, such that the trigger spring may be circumferentially positioned as shown in FIG. 8B. One end of the trigger spring may rest against the receiver housing and the other end of the spring wrap under the trigger system as shown in FIG. 8B, and contact the second portion trigger bar 1001.

As shown in FIG. 8B, the first portion trigger bar 91 can have some movement relative to the second portion trigger bar 1001. When the hammer is in the already fired position, the trigger spring imposes an upward force on the second portion trigger bar such that the lip 1005 of the second portion trigger bar is in contact with the hammer. Between the spring and hammer, the second portion trigger bar is relative stationary within the system. However, the first portion trigger bar 91 may rotate about the axis of the trigger pin. The second portion trigger bar 91 can move between a first position in which the forward projection 95 contacts the connecting part of the second portion trigger bar and a second position in which the forward projection 95 contacts the hammer. The rotation of the first portion trigger bar may be small, but it is sufficient to permit the selector shaft to rotate between the ready to fire position and the safety position.

Exemplary embodiments include methods of making the device described herein by molding, casting, and/or machining first portion trigger bar, second portion trigger bar, and other component parts as described herein.

Exemplary embodiments include methods of using the device described herein. For example, a user may remove the current fire controls and install the upgraded fire controls, which allow the weapon to be in "safe" mode at all times.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

Although embodiments of the invention may be described and illustrated herein in terms of M4/AR-15 rifles, it should be understood that embodiments of this invention are not so limited, but are additionally applicable to variants thereof.

FIGS. 11-12 illustrate exemplary exploded component part views of control systems according to embodiments described herein. FIG. 11 illustrates an exemplary control system for an AR15, while FIG. 12 illustrates an exemplary control system for an M16 having automatic firing. As described herein each of the systems includes a trigger 1101, 1201, hammer 1102, 1202, safety selector 1103, 1203, and disconnector 1104, 1204. Similar parts are identified with the same ending portion of a reference number. The trigger 1101, 1201 may be made according to the embodiments described herein including a two part system or otherwise permitting a first end of the trigger to move relative to an opposite end of the trigger to permit the positioning of the safety selector regardless of the position of the hammer.

As seen by a comparison between FIG. 11 and FIG. 12, the AR15 hammer includes a hooked end 1105 and smooth, rounded exterior edge 1106 of the hook, while the M16 includes a projection 1205 from the end of the hook and a more squared off profile of the outer edge 1206 of the hook end. The profiles 1107, 1207 at a central portion of the hammer are also altered. The safety selector, of course includes variations between the two weapons. The safety selector 1103 of the AR15 includes a single profile shaft 1110 as the selector has two settings of off and on. The safety selector 1203 of the M16 has a multiple profile shaft 1210 as the selector has additional settings for automatic firing. Therefore, the safety selector 1203 of the M16 includes multiple portions having different cut out profiles for engaging and disengaging contact of the safety selector with different components of the system. The disconnector 1104, 1204 and trigger 1101, 1201 also have different alignment features. For example, the trigger 1101 of the AR 15 has a closed end 1109, while the trigger 1201 of the M16 has an open end 1209. The disconnector of the AR15 includes a hooked end 1108 that ends in the profile of the hook, while the disconnector 1204 of the M16 includes an additional extension 1208 past the hook.

Exemplary embodiments are provided herein in which the trigger is separated into more than one component part. However, exemplary embodiments are not limited to the specific separation of two component parts. Exemplary embodiments may include one, two, three, four, or more parts to create and define a trigger. For example, an exemplary trigger and trigger bar may be of a single component construction and configured to flex or otherwise have one portion more relative to another portion. In this case, the single component may comprise a plastic or non-metal. The flexibility of the material may allow for the hammer to be charged while in the safe position. The flexibility of the trigger may allow for the hammer to charge without excessive friction or binding during the process of charging, or making ready the firearm to discharge a round while the selector is in the safe position.

The trigger is configured such that a portion of the trigger may move relative to another portion of the trigger. The trigger may be the component part or set of component parts that includes a first portion for which a user depresses or otherwise engages the weapon to fire, a second portion configured to contact the hammer to hold the hammer in a ready to fire position and to move relative to the hammer when the first portion is engaged by the user to release the hammer and permit the weapon to fire, and a third portion to contact the selector and prevent the user from engaging the first portion and releasing the hammer and keep the weapon in a safe mode.

Exemplary embodiments permit the second portion and third portion to move relative to each other. Exemplary embodiments permit the first portion to move the second portion when the first portion is engaged by a user. Exemplary embodiments permit the third portion to prevent the movement of the first portion and/or second portion when a selector is positioned in a safety mode. Exemplary embodiments permit the selector to be in contact with the third portion when the selector is positioned in a safety mode. Exemplary embodiments permit the selector to transition between a ready to fire mode and a safety mode regardless of the position of the first portion, second portion, hammer, and combinations thereof.

Exemplary embodiments include a control group for a weapon, comprising a trigger having a first portion configured to be engaged by a user to fire the weapon, a second portion configured to contact a hammer and retain the hammer in a ready to fire position and to move relative to the hammer when the first portion is engaged by a user to release the hammer and fire the weapon, and a third portion configured to contact a selector and prevent the firing of the weapon when the weapon is in a safe mode. The control group may be configured such that the second portion and third portion move relative to each other.

Exemplary embodiments include a method of transitioning a rifle into a safe mode, comprising providing a rifle comprising a hammer, a selector, and a trigger having a first portion configured to be engaged by a user to fire the weapon, a second portion configured to contact the hammer and retain the hammer in a ready to fire position and to move relative to the hammer when the first portion is engaged by a user to release the hammer and fire the weapon, and a third portion configured to contact a selector and prevent the firing of the weapon when the weapon is in a safe mode; positioning the selector into the safe mode position before the hammer is positioned in the ready to fire position; transitioning the hammer into contact with the second portion to retain the hammer in a ready to fire position after the selector is positioned into the safe mode position. The positioning of the selector may include moving the second portion relative to the first portion during the transition of the selector.

Exemplary benefits may include any combination of requiring no lubrication, enhanced safety of the rifle platform, quality trigger with a crisp reset, lightweight and resilient, composite or heat-treated steel.

Exemplary embodiments of the trigger system described herein may include the original positional specifications and locations of the hammer and trigger pin holes in the receiver, as well as the safety location. Accordingly, exemplary embodiments described herein may be provided as a trigger assembly that may be incorporated into an AR15/M16/M4 fire control system, regardless of calibre, or variants thereof, without having to alter the receiver.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A weapon, comprising:

a hammer comprising a single piece rotatable about a hammer axis having a first end with an indentation and an opposing end configured to contact a firing pin to fire the weapon;

a selector rotatable about a selector axis having a first position defining a safe mode of the weapon in which the weapon is prevented from firing and a firing mode in which the weapon can fire;

a trigger comprising two pieces, wherein:

the first piece has a first end configured to be engaged by a user to fire the weapon and a second end configured to directly contact the selector and prevent the firing of the weapon when the weapon is in the safe mode, and the second piece has a contact surface to directly contact the hammer at the indentation and retain the hammer in a ready to fire position and to move relative to the hammer when the first portion is engaged by a user to release the hammer and fire the weapon, the first piece and the second piece rotatable about a trigger axis, one of the first piece and the second piece comprising a projection and the other of the second piece and the first piece comprising an engagement surface, wherein the engagement surface is a surface extending between a first part and a second part where the first part and the second part extend from the trigger axis on opposing sides of the projection, and wherein the engagement surface is configured to contact the projection such that when the first end of the first piece is engaged by a user and the weapon is in the firing mode, the projection contacts the engagement surface and the first piece and second piece rotate together about the trigger axis to disengage the second piece from the hammer to permit the hammer to rotate about the hammer axis and fire the weapon, and when the weapon is in safe mode the first piece is in contact with the selector to prevent rotation of the first piece about the trigger axis to fire the weapon and the second piece rotates independently of the first piece about the trigger axis such that the projection is out of contact with the engagement surface and permits the hammer to rotate so the contact surface of the second piece is brought from out of contact to in contact with the hammer at the indentation to retain the hammer in a ready to fire position, the weapon is configured to be in the safe mode before positioning the hammer in a ready to fire position and permitting the weapon to be positioned in the ready to fire position while retained in the safe mode.

2. The weapon of claim 1, wherein the selector comprising an indentation and in a firing mode the indentation is positioned proximate the first piece where the second end is out of contact with the selector and the first piece is permitted to rotate about the trigger axis and into the indentation to fire the weapon.

3. The weapon of claim 2, further comprising a trigger spring configured to couple about the trigger axis and bias the first piece and the second piece where the second piece is toward the hammer.

4. The weapon of claim 1, wherein the projection is on the first piece and extends generally linearly on an opposing side of the trigger axis from the second end.

5. The weapon of claim 1, wherein the projection is on the second piece and extends forward and further away from the trigger axis than the contact surface.

6. The weapon of claim 1, wherein the weapon is a rifle.

7. The weapon of claim 6, wherein the selector axis defines a first rotational axis, the hammer axis defines a second rotational axis, and the trigger axis defines a third rotational axis, wherein each of the first, second, and third rotational axis correspond to pin holes within an original receiver housing of the weapon such that the hammer, the trigger, and the selector are configured to be incorporated into an original control system without having to alter an original receiver, and the selector, the trigger, and the hammer requiring only the three rotational axes.

8. The weapon of claim 7, wherein the selector is out of contact with the hammer during an entire use of the control group.

9. The weapon of claim 8, wherein the first piece is a single integrated unit, wherein the integrated unit includes an aperture to accommodate a trigger pin to connect the trigger to the weapon and the second piece includes an aperture to accommodate the trigger pin, the integrated unit having a third end the third end extending forward the first end and extending on an opposite side of the trigger pin than the second end, the third end defined by a first side and a second side and the engagement surface extending between the first side and the second side, the second piece positioned between the first side and the second side, the second piece having the projection, the trigger further comprising a trigger spring configured to attach at the trigger pin and contact the trigger and the original receiver housing.

10. A method of transitioning a rifle into a safe mode, comprising:

providing a rifle having:

a hammer comprising a single piece rotatable about a hammer axis having a first end with an indentation and an opposing end configured to contact a firing pin to fire the weapon, a selector rotatable about a selector axis having a first position defining a safe mode of the weapon in which the weapon is prevented from firing and a firing mode in which the weapon can fire, and a trigger comprising two pieces, the first piece having a first end and a second end and a second piece having a contact surface, the first piece and the second piece rotatable about a trigger axis, one of the first piece and the second piece comprising a projection and the other of the second piece and the first piece comprising an engagement surface, wherein the engagement surface is a surface extending between a first part and a second part where the first part and the second part extend from the trigger axis on opposing sides of the projection;

positioning the selector into the safe mode position before the hammer is positioned in the ready to fire position, in safe mode defined by a first rotational position of the selector where the selector is in contact with a second end of the first piece of the trigger thereby preventing the first piece from rotating about the trigger axis when the first end is contacted and engaged by a user;

transitioning the hammer such that an indentation surface of the hammer is in contact with a contact surface of the second piece to retain the hammer in a ready to fire position while the selector is positioned in the safe mode position, during the transitioning the second piece rotates independently of the first piece about the trigger axis such that the projection is out of contact with the engagement surface and permits the hammer to rotate independent of the first piece and second piece and regardless of a position of the selector;

positioning the selector into a fire mode position by rotating the selector such that an indentation of the selector is positioned adjacent the first piece and the first piece is out of contact with the selector; and firing the weapon when the selector is in the fire mode by contacting and applying pressure to the first end of the first piece so the projection is in contact with the engagement surface such that the first piece and the second piece rotate together about the trigger axis to disengage the second piece from the hammer to permit the hammer to rotate about the hammer axis and fire the weapon.

11. The method of claim 10, wherein the selector comprises a contoured shaft that is rotated into a first position to contact the trigger and the rotation of the selector prevents firing of the weapon and a second position to be out of contact with the trigger and permit the firing of the weapon.

* * * * *